US007856113B2

(12) United States Patent
Yang

(10) Patent No.: US 7,856,113 B2
(45) Date of Patent: Dec. 21, 2010

(54) MULTI-MICROPHONE CAPSULE

(75) Inventor: Feng Yang, Plano, TX (US)

(73) Assignee: Fortemedia, Inc., Cupertino, CA (US)

( * ) Notice: Subject to any disclaimer, the term of this patent is extended or adjusted under 35 U.S.C. 154(b) by 1251 days.

(21) Appl. No.: 11/419,222

(22) Filed: May 19, 2006

(65) Prior Publication Data

US 2006/0262946 A1 Nov. 23, 2006

Related U.S. Application Data

(60) Provisional application No. 60/683,046, filed on May 20, 2005.

(51) Int. Cl.
*H04R 25/00* (2006.01)

(52) U.S. Cl. ..... 381/355; 381/356; 381/357

(58) Field of Classification Search ..... 381/92, 381/313, 355, 356, 357, 358, 359, 360, 174, 381/369

See application file for complete search history.

(56) References Cited

U.S. PATENT DOCUMENTS 3,875,349 A * 4/1975 Ruegg ..... 381/313
6,151,399 A * 11/2000 Killion et al. ..... 381/313
2005/0031136 A1 2/2005 Du et al.

* cited by examiner

*Primary Examiner*—Huyen D Le
(74) *Attorney, Agent, or Firm*—Thomas, Kayden, Horstemeyer & Risley

(57) ABSTRACT

A multi-microphone capsule includes a housing, a plurality of microphones disposed in the housing, and an acoustic seal also disposed in the housing, wherein the microphones include an omni-directional microphone, a uni-directional microphone, or combinations thereof. The microphones are placed front-and-back or side-by-side, or a part of the microphones are placed side-by-side and the other microphones are placed front-and-back with the part of the microphones.

10 Claims, 9 Drawing Sheets

MULTI-MICROPHONE CAPSULE

BACKGROUND OF THE INVENTION

1. Field of the Invention

The invention relates to a multi-microphone capsule with a plurality of microphones disposed inside.

2. Description of the Related Art

FIG. 1 shows a conventional microphone capsule 100 that is used for various voice communication devices. The microphone capsule 100 includes an electret sensor 120 and a J-channel field effect transistor (J-FET) 140 that are mounted within a housing 110. The electret sensor 120 implements a single microphone. An electret is a dielectric material that has been permanently electrically charged or polarized. Incoming sound waves enter via a top opening 112 and are translated into mechanical vibrations upon contacting the electret sensor 120. The electret sensor 120 converts the sound vibrations into an electrical signal that varies in voltage amplitude and frequency corresponding to the original sound. The J-FET 140 receives and amplifies the electrical signal from the electret sensor 120 and provides an output signal. The J-FET 140 is mounted on a printed circuit board (PCB) 130 and is further coupled to external circuitry via openings 150 formed at the bottom of the housing 110.

FIG. 2 is a schematic diagram of the conventional microphone capsule 100 and an electronic unit 190. The electret sensor 120, for the microphone capsule 100, is modeled with a voltage source that generates an electrical signal based on the incoming sound. The J-FET 140 amplifies the electrical signal and provides the output signal to the electronic unit 190.

The electronic unit 190 includes a resistor 192, a capacitor 194, and an amplifier (Amp) 196. The resistor 192, coupled between a supply voltage (Vcc) and the drain of the J-FET 140, acts as the circuit load for the J-FET 140, and further provides bias current for the J-FET 140. The resistor 192 is typically a small value (e.g., 1 KΩ). The output signal from the drain of the J-FET 140 includes an alternating current (AC) portion for the desired audio signal and a direct current (DC) portion for the bias current for the J-FET 140. The capacitor 194 couples between the drain of the J-FET 140 and the input of the amplifier 196, performs AC coupling (or DC blocking), and passes the AC portion for the desired audio signal to the amplifier 196. The amplifier 196 amplifies the audio signal and provides an amplified signal to subsequent circuit blocks (not shown in FIG. 2).

As shown in FIG. 2, the microphone capsule 100 typically includes two electrical contacts for (1) the output signal, which includes the desired audio signal and bias current, and (2) circuit ground.

The microphone capsule 100 includes a single microphone that is implemented with a single electret sensor 120. Depending on the design of the microphone capsule 100, this single microphone may be an omni-directional microphone or a uni-directional microphone.

FIG. 3A shows a beam pattern for an omni-directional microphone, which is roughly equally sensitive to sound coming in from all directions. An omni-directional microphone may be created for the microphone capsule 100 by not having any openings for sound at the bottom of the housing 110, not shown in FIG. 1.

FIG. 3B shows a beam pattern for a uni-directional microphone, which is more sensitive to sound coming in from a particular direction (typically the front side). FIG. 3B shows a cardioid microphone, which is a common type of uni-directional microphone, having a beam pattern resembling the shape of a heart. A uni-directional microphone may be created for the microphone capsule 100 by forming openings 150 for sound at the bottom of the housing 110 (as shown in FIG. 1). Incoming sound waves then enter the microphone capsule 100 via both the top and bottom openings 112 and 150. The sound waves received via the bottom openings 150 are canceled by the sound waves received via the top opening 112, thereby creating low sensitivity for the bottom side.

FIGS. 3A and 3B show two beam patterns for a microphone. Other beam patterns, such as a bi-directional (or dipole) pattern, may also be formed with different placement of acoustic openings.

BRIEF SUMMARY OF THE INVENTION

The invention provides a multi-microphone capsule having a plurality of microphones inside.

A multi-microphone capsule in accordance with the invention includes a housing, a plurality of microphones disposed in the housing, and an acoustic seal also disposed in the housing. The microphones include an omni-directional microphone, a uni-directional microphone, or combinations thereof. The microphones in the housing are placed front-and-back or side-by-side, or a part of the microphones are placed side-by-side and the other microphones are placed front-and-back with the part of the microphones.

The multi-microphone capsule of the invention has merits of small size, low power consumption, and capability for providing various functionalities.

BRIEF DESCRIPTION OF THE DRAWINGS

The invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 4A:
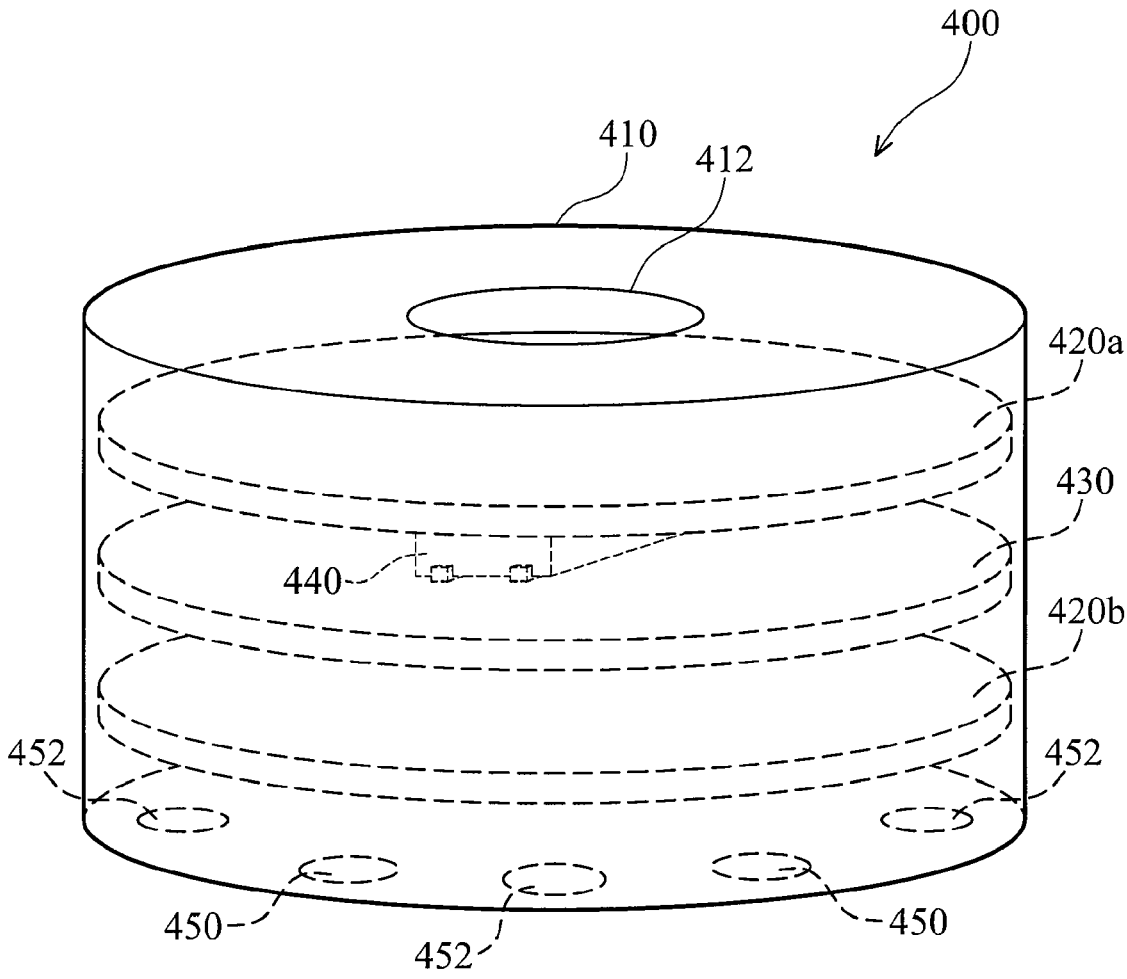
FIG. 4A shows a multi-microphone capsule with two omni-directional microphones according to an embodiment of the invention.

FIG. 4A shows a multi-microphone capsule 400 with two omni-directional front-and-back microphones. The capsule 400 includes a first electret sensor 420*a*, a second electret sensor 420*b*, and an integrated circuit (IC) 440, all of which are mounted within a cylindrical housing 410. The housing 410 has a top opening 412 and a plurality of bottom openings 452 for sound, and has a plurality of bottom openings 450 for electrical contacts of the IC 440 with external circuitry (not shown). The first and second electret sensors 420*a* and 420*b* implement two omni-directional microphones and are acoustically separated by an acoustic seal 430. In this embodiment, the acoustic seal 430 is a printed circuit board on which the integrated circuit 440 is mounted. The first electret sensor 420*a*receives incoming sound waves via the top opening 412 and converts these sound waves into a first electrical signal. The second electret sensor 420*b* receives incoming sound waves via the bottom openings 452 and converts these sound waves into a second electrical signal. The integrated circuit 440 receives and processes the first and second electrical signals and provides an output signal.

Figure 4B:
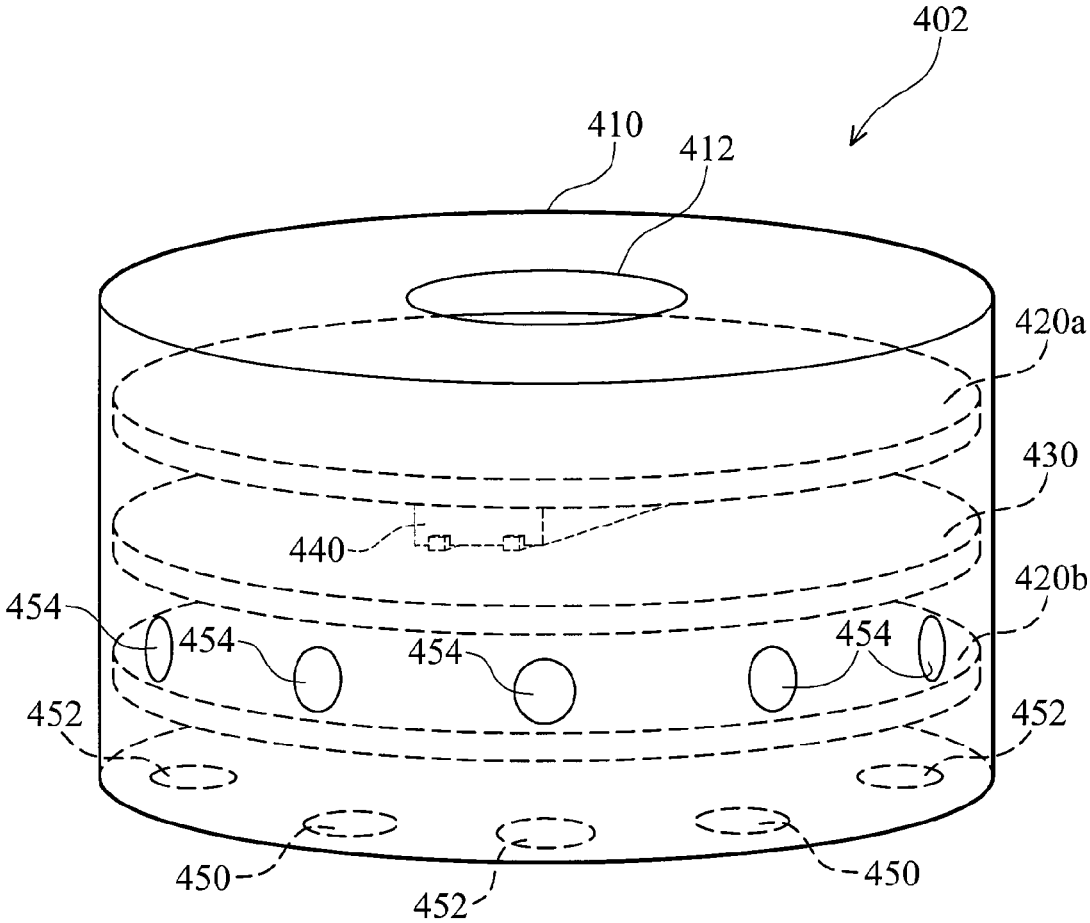
FIG. 4B shows a multi-microphone capsule with an omni-directional microphone and a unidirectional microphone according to another embodiment of the invention.

FIG. 4B shows a multi-microphone capsule 402 with an omni-directional microphone and a unidirectional microphone, which are placed front-and-back. The capsule 402 includes electret sensors 420*a* and 420*b*, an integrated circuit 440, and acoustic openings 412 and 452, as described above for FIG. 4A. The capsule 402 further includes side openings 454 for receiving sound waves on the electret sensor 420*b*. The sound waves received via the bottom openings 452 are canceled by the sound waves received via the side openings 454, thereby creating low sensitivity for the bottom. For the capsule 402, the electret sensor 420*a* implements an omni-directional microphone, and the electret sensor 420*b* implements a unidirectional microphone.

Figure 4C:
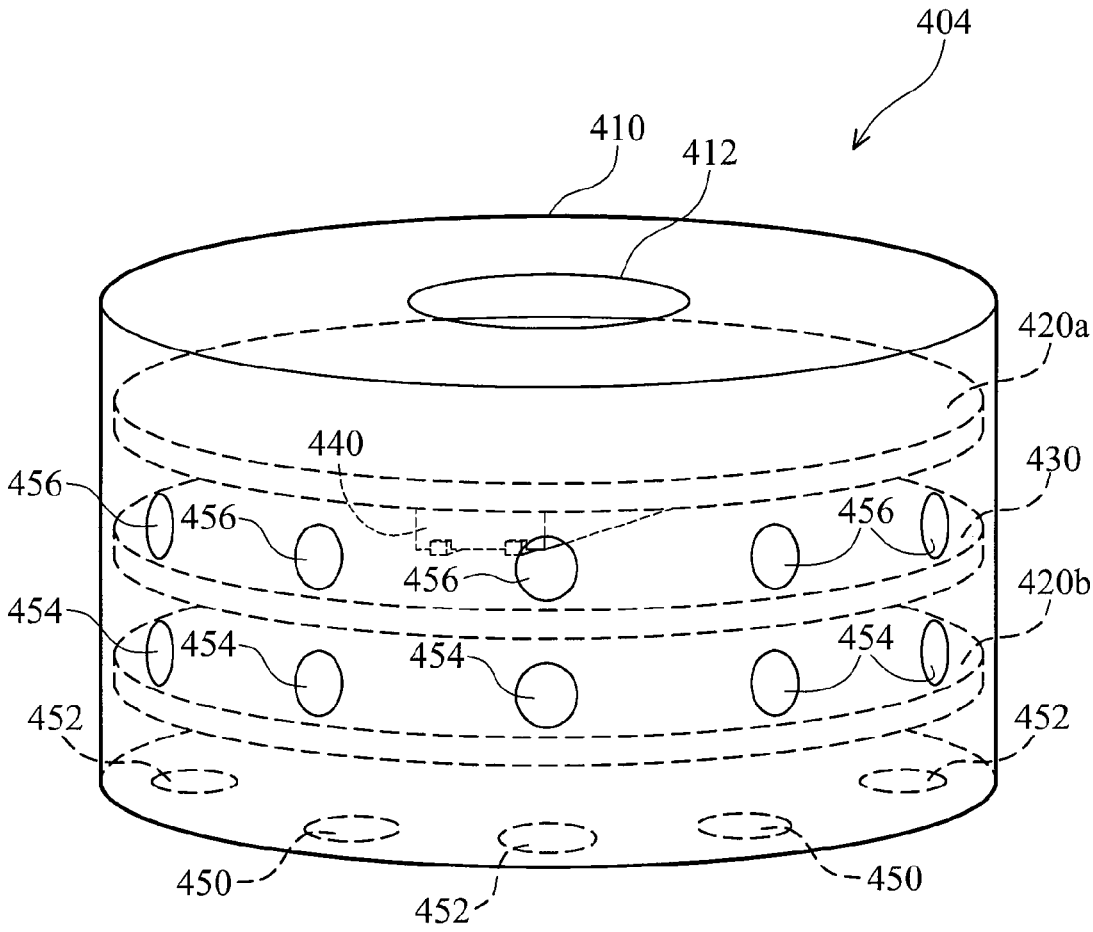
FIG. 4C shows a multi-microphone capsule with two uni-directional microphones according to another embodiment of the invention.

FIG. 4C shows a multi-microphone capsule 404 with two uni-directional front-and-back microphones. The capsule 404 includes electret sensors 420*a* and 420*b*, an integrated circuit 440, and acoustic openings 412, 452 and 454, as described above for FIG. 4B. The capsule 404 further includes side openings 456 for receiving sound waves on the electret sensor 420*a*. The sound waves received via the side openings 456 are canceled by the sound waves received via the top opening 412, thereby creating low sensitivity for the side and bottom. For the capsule 404, the electret sensors 420*a* and 420*b* implement two uni-directional microphones.

FIGS. 4A through 4C show three microphone capsules with two front-and-back microphones. More than two front-and-back microphones may also be implemented with additional electret sensors and acoustic seals between electret sensors. Different types of microphone (e.g., omni-directional microphone, uni-directional microphone, and so on) and different beam patterns may be obtained by providing appropriate openings for sound. The size, shape, and placement of the acoustic openings may be selected to obtain the desired beam pattern for each microphone.

Figure 5:
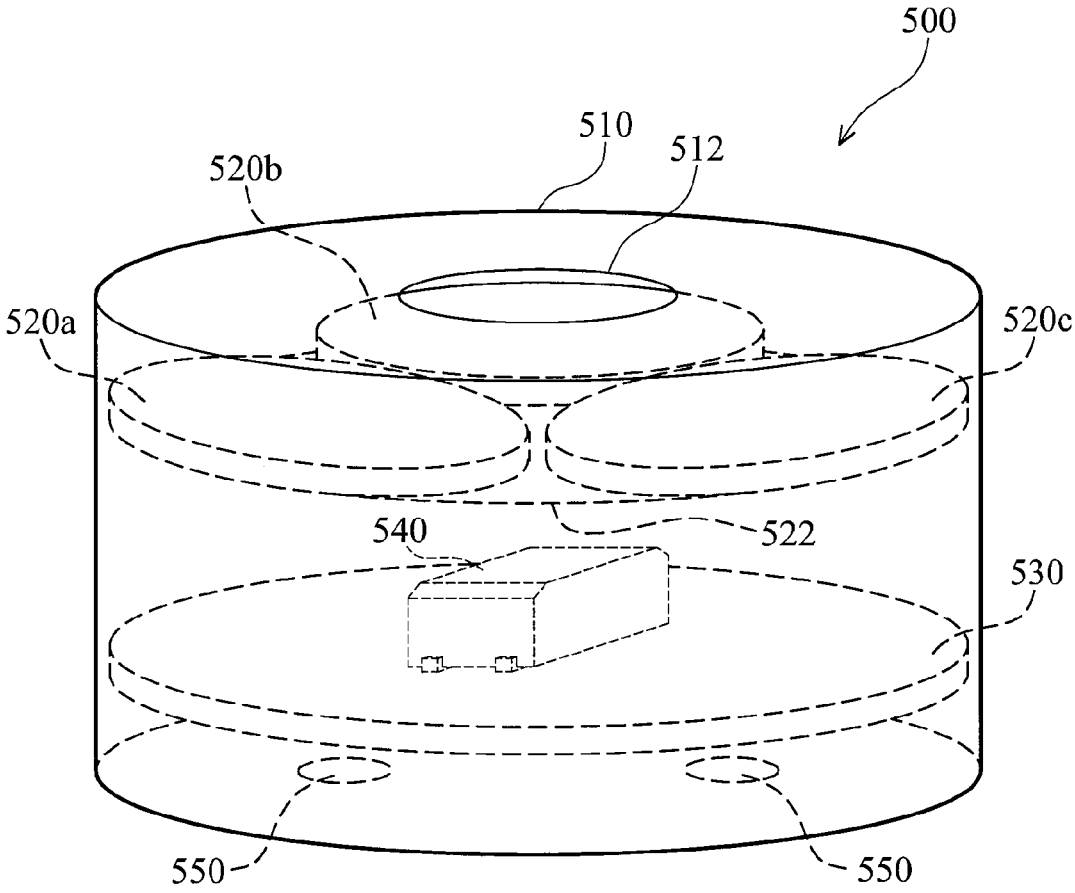
FIG. 5 shows a multi-microphone capsule with three side-by-side microphones according to another embodiment of the invention.

FIG. 5 shows a multi-microphone capsule 500 with three side-by-side microphones. The capsule 500 includes three electret sensors 520*a*, 520*b* and 520*c* that are mounted on a plate 522 within a housing 510. An integrated circuit 540 is mounted on a printed circuit board 530 within the housing 510. The electret sensors 520*a*, 520*b* and 520*c* implement three microphones, each of which may be an omni-directional microphone or a uni-directional microphone depending on the placement of the electret sensor, the openings for receiving sound waves, and possibly other factors. In this embodiment, an opening 512 is provided at the top of the housing 510 to receive incoming sound waves for the electret sensors 520*a*, 520*b*, and 520*c*. Openings 550 are provided at the bottom for electrical contacts.

Figure 6:
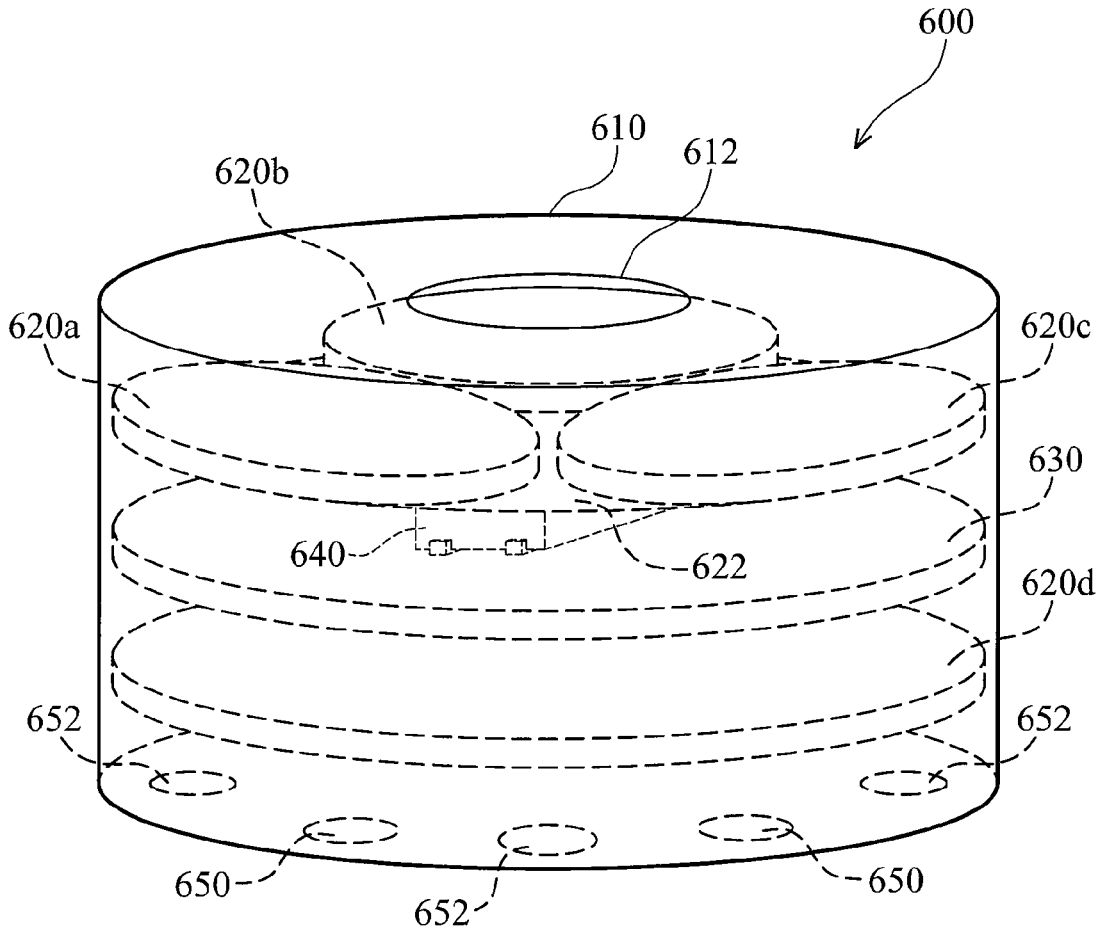
FIG. 6 shows a multi-microphone capsule with four microphones according to another embodiment of the invention.

FIG. 6 shows a multi-microphone capsule 600 with four microphones. The capsule 600 includes three electret sensors 620*a*, 620*b* and 620*c* that are mounted on a plate 622 within a housing 610. The capsule 600 further includes an electret sensor 620*d* that is mounted toward the bottom of the housing 610 and is acoustically separated from the electret sensors 620*a*, 620*b* and 620*c* by an acoustic seal 630. The electret sensors 620*a* through 620*d* implement four microphones, with three microphones being mounted side-by-side and the fourth microphone being mounted front-and-back with the other three microphones. Each of the four microphones may be an omni-directional microphone or a unidirectional microphone depending on the placement of the electret sensor, the openings for receiving sound waves, and possibly other factors. In this embodiment, an integrated circuit 640 is mounted on a printed circuit board 630 serving as the acoustic seal. An opening 612 at the top of the housing 610 receives incoming sound waves for the electret sensors 620*a* through 620*c*. Openings 652 at the bottom of the housing 610 receive incoming sound waves for the electret sensor 620*d*. Also, openings 650 are provided at the bottom for electrical contacts of the integrated circuit 640 with external circuitry.

FIGS. 4A through 6 show some exemplary multi-microphone capsules having a microphone array. In general, a multi-microphone capsule may include any number of microphones, which may be mounted in various manners (e.g., front-and-back, side-by-side, and so on). Each microphone may also be an omni-directional microphone or a uni-directional microphone. Other multi-microphone capsules may also be designed based on the description provided herein, and these other multi-microphone capsules are within the scope of the invention.

A multi-microphone capsule with multiple microphones has various advantages over a microphone capsule with a single microphone. The multiple microphones may be used to reduce noise for many applications. The multiple microphones may also be used to reduce echo for speakerphone and other applications.

Figure 1:
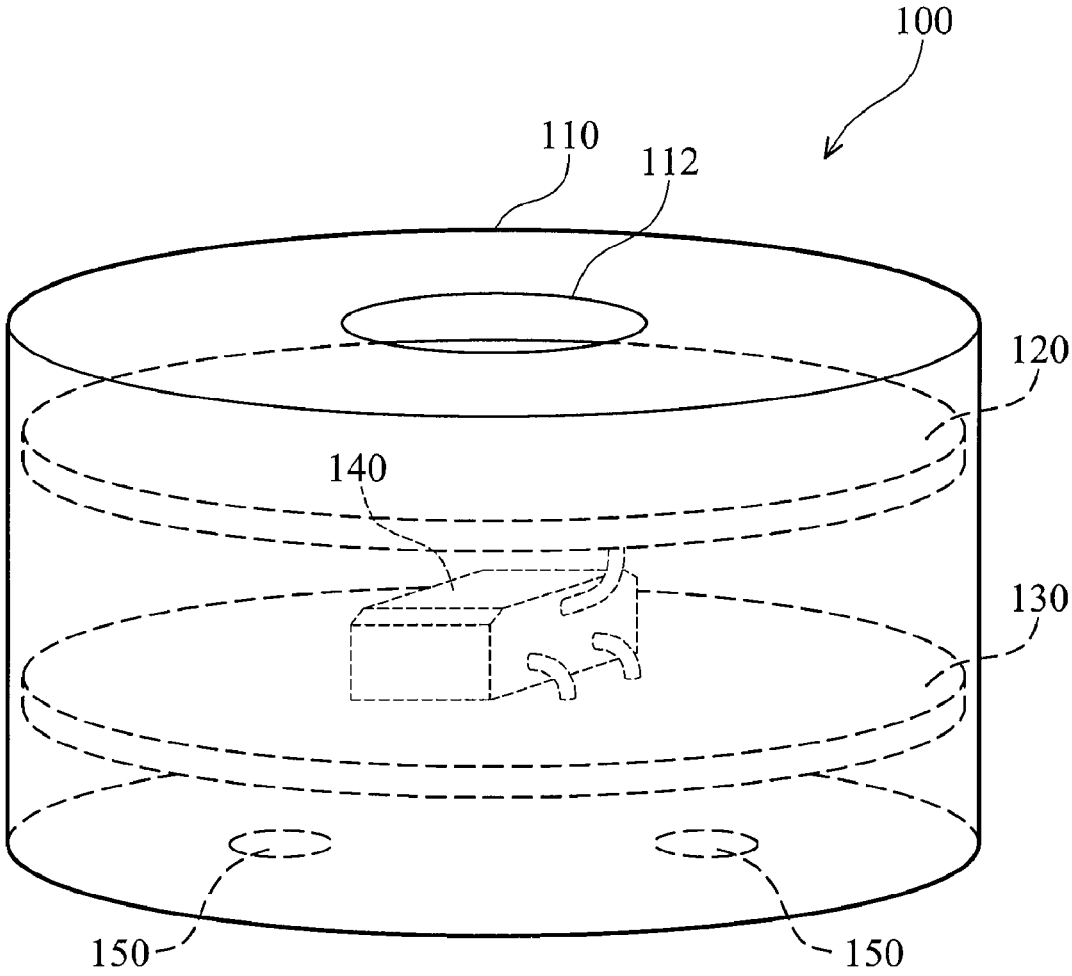
FIG. 1 ( RELATED ART )
FIG. 1 shows a conventional microphone capsule.
Figure 2:
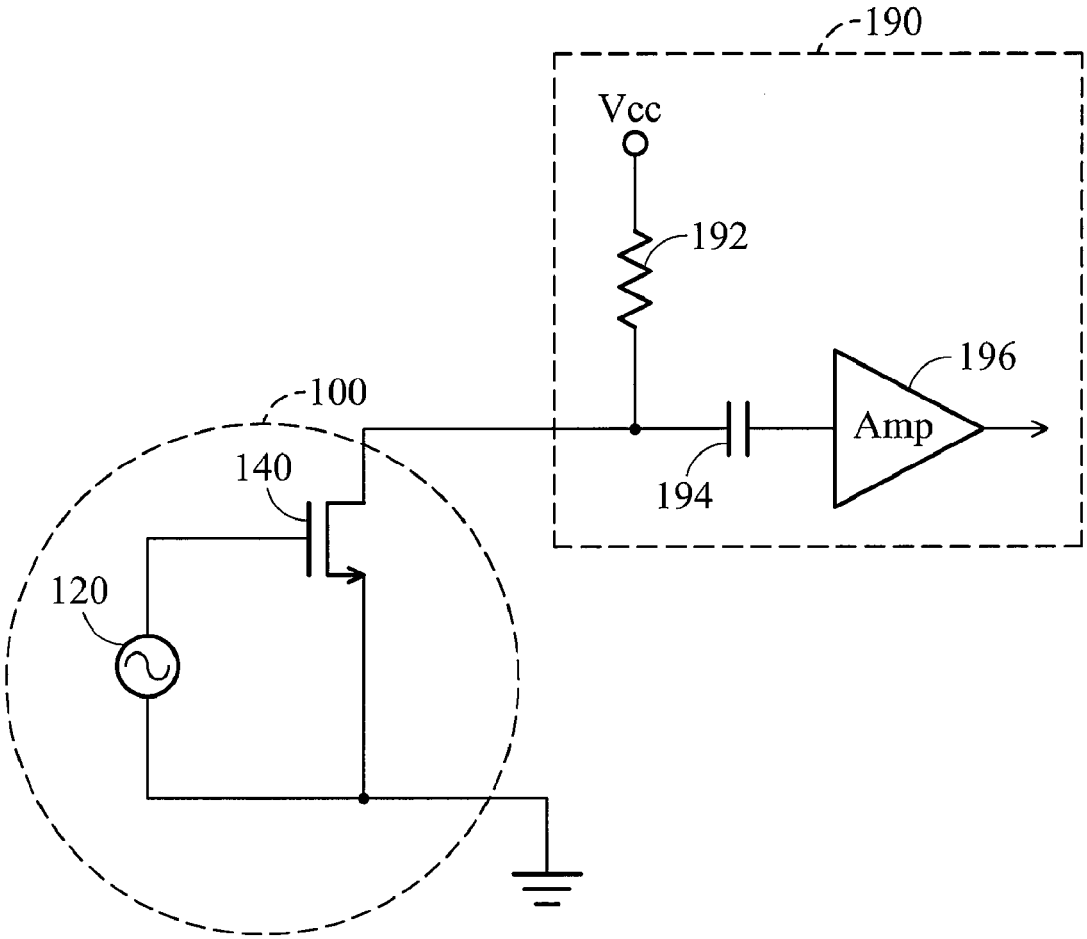
FIG. 2 ( RELATED ART )
FIG. 2 is a schematic diagram of the conventional microphone capsule and an electronic unit.
Figure 3A:
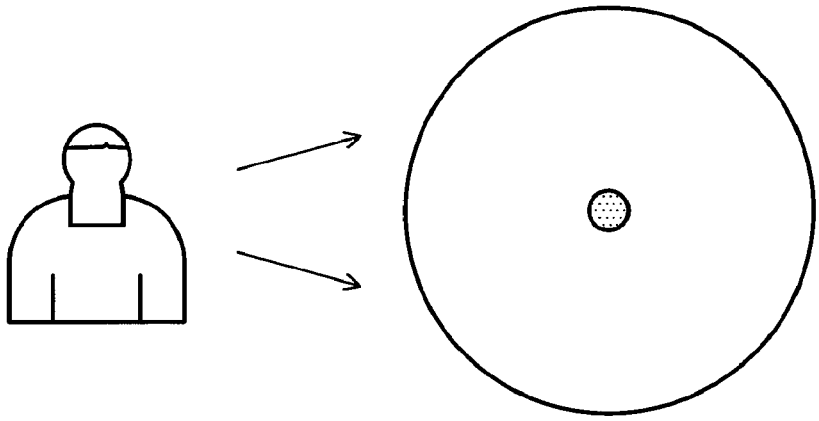
FIG. 3A ( RELATED ART )
FIG. 3A shows a beam pattern of an omni-directional microphone.
Figure 3B:
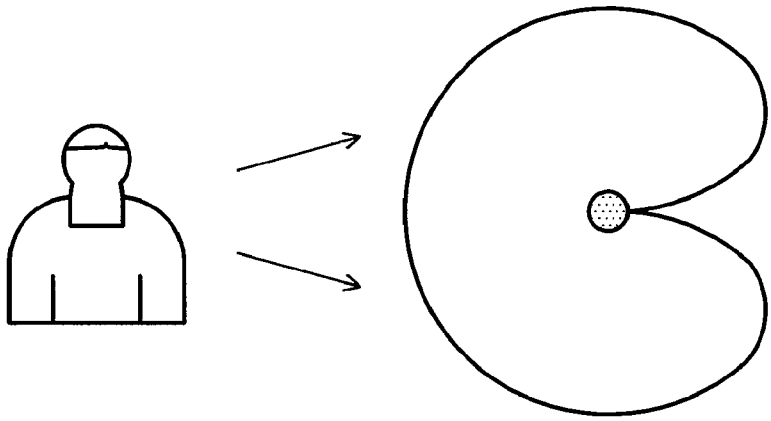
FIG. 3B ( RELATED ART )
FIG. 3B shows a beam pattern of a uni-directional microphone.

A multi-microphone capsule may be designed to have the same or similar housing and acoustic opening as the conventional single-microphone capsule 100 shown in FIG. 1. For example, the multi-microphone capsule 500 in FIG. 5 has the same housing and top acoustic opening as the microphone capsule 100, the multi-microphone capsules 400 and 600 have additional acoustic openings on the bottom of the housing in comparison to the microphone capsule 100, and the multi-microphone capsules 402 and 404 have additional acoustic openings on the bottom and side of the housing in comparison to the microphone capsule 100. A multi-microphone capsule has the same housing dimension as a conventional microphone capsule and may be used as a physical drop-in replacement for the conventional microphone capsule.

For simplicity, FIGS. 4A through 6 show a single integrated circuit being included in each multi-microphone capsule. In general, a multi-microphone capsule may include any support circuitry that can perform signal conditioning and possibly digital signal processing for the electrical signals provided by the electret sensors. The support circuitry may be implemented within one or more integrated circuits, with discrete components, and so on, or any combination thereof.

An integrated circuit is an attractive implementation of the support circuitry for a multi-microphone capsule because of its small size, low power consumption, and various functionalities.

Figure 7:
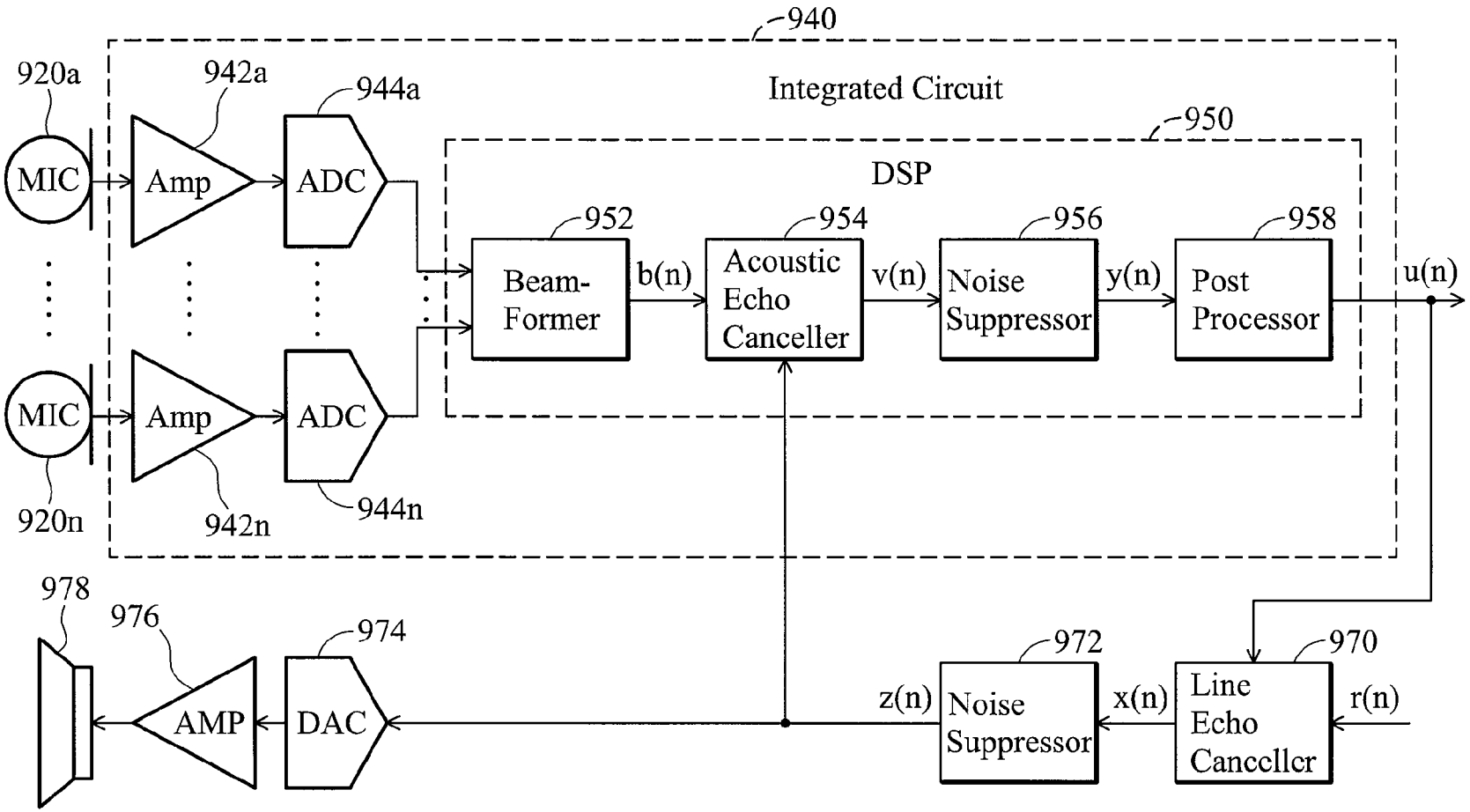
FIG. 7 is a block diagram of an embodiment of the signal processing for a multi-microphone capsule of the invention.

FIG. 7 is a block diagram of an embodiment of the signal processing for a multi-microphone capsule of the invention.

For near-end speech, microphones 920*a* through 920*n* receive sound signals and provide near-end input signals to amplifiers 942*a* through 942*n*, respectively, within an integrated circuit 940. Each amplifier 942*a* (942*b* . . . 942*n*) amplifies its input signal and provides an amplified near-end signal to an analog-to-digital converter (ADC) 944*a* (944*b* . . . 944*n*). Each ADC 944*a* (944*b* . . . 944*n*) digitizes its amplified near-end signal from the corresponding amplifier 942*a* (942*b* . . . 942*n*) and provides a digitized signal to a DSP 950. Within the DSP 950, a beam-former 952 receives the digitized signals from all ADCs 944*a* (944*b* . . . 944*n*), performs beamforming on these signals, and provides a beamformed signal b(n). An acoustic echo canceller 954 receives the beamformed signal b(n) and a far-end output signal z(n) from a noise suppressor 972. The acoustic echo canceller 954 performs acoustic echo cancellation to remove echo from a loudspeaker 978 and provides an echo-canceled near-end signal v(n).

A noise suppression unit 956 receives the echo-canceled near-end signal v(n), performs noise suppression to remove noise in the signal v(n), and provides a noise-suppressed near-end signal y(n). A post-processor 958 receives the noise-suppressed near-end signal y(n), performs post-processing, and provides a processed near-end signal u(n), which is a digital data stream.

For far-end speech, a line echo canceller 970 receives a far-end signal r(n) and the processed near-end signal u(n) from the post-processor 958, performs line echo cancellation on the received far-end signal r(n) to remove echo from near-end voice, and provides an echo-canceled far-end signal x(n). The noise suppressor 972 receives the echo-canceled far-end signal, performs noise suppression to remove noise, and provides the far-end output signal z(n). The far-end output signal z(n) is converted to analog by a digital-to-analog converter (DAC) 974. An amplifier 976 amplifies the analog signal and provides an amplified far-end output signal to the loudspeaker 978.

The various processing blocks in FIG. 7, such as the beamformer 952, acoustic echo canceller 954, noise suppressor 956, line echo canceller 970, and noise suppressor 972 may be implemented in various manners known in the art.

The beam-forming, echo cancellation, and noise suppression may be implemented by various means. For example, the beam-forming, echo cancellation, and noise suppression may be implemented in hardware, software, or a combination thereof. For a hardware implementation, the processing units used to perform echo cancellation and noise suppression may be implemented within one or more application specific integrated circuits (ASICs), digital signal processors (DSPs), digital signal processing devices (DSPDs), programmable logic devices (PLDs), field programmable gate arrays (FPGAs), processors, controllers, micro-controllers, microprocessors, other electronic units designed to perform the functions described herein, or a combination thereof.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A multi-microphone capsule, comprising:

a housing;

a first electret sensor disposed in the housing;

a second electret sensor disposed in the housing; and an integrated circuit disposed in the housing, receiving and amplifying electrical signal from the first and second electret sensors an acoustic seal disposed between the first and second electret sensors, wherein the housing comprises a first acoustic opening receiving first sound waves on the first electret sensor, and a second acoustic opening receiving second sound waves on the second electret sensor, wherein the housing is cylindrical and further comprises a top, a bottom, and sides connecting the top and the bottom, the first acoustic opening is formed at the top, and the second acoustic opening is formed at the bottom.

2. The multi-microphone capsule as claimed in claim 1, wherein the acoustic seal is a printed circuit board.

3. A multi-microphone capsule, comprising:

a housing;

a first electret sensor disposed in the housing;

a second electret sensor disposed in the housing;

an integrated circuit disposed in the housing, receiving and amplifying electrical signal from the first and second electret sensors; and an acoustic seal disposed between the first and second electret sensors, wherein the housing comprises a first acoustic opening, a second acoustic opening, and a third acoustic opening; the first acoustic opening receives first sound waves on the first electret sensor; and the second and third acoustic openings respectively receive second and third sound waves on opposite surfaces of the second electret sensor, wherein the housing is cylindrical and further comprises a top, a bottom, and sides connecting the top and the bottom; the first acoustic opening is formed at the top; the second acoustic opening is formed at the bottom; and the third acoustic opening is formed at the sides.

4. A multi-microphone capsule, comprising:

a housing;

a first electret sensor disposed in the housing;

a second electret sensor disposed in the housing;

an integrated circuit disposed in the housing, receiving and amplifying electrical signal from the first and second electret sensors; and an acoustic seal disposed between the first and second electret sensors, wherein the first electret sensor comprises a first surface and a second surface opposite the first surface; the second electret sensor comprises a third surface and a fourth surface opposite the third surface; the housing comprises a first acoustic opening, a second acoustic opening, a third acoustic opening, and a fourth acoustic opening; the first and second acoustic openings respectively receive first and second sound waves on the first and second surfaces of the first electret sensor; and the third and fourth acoustic openings respectively receive third and fourth sound waves on the third and fourth surfaces of the second electret sensor.

5. The multi-microphone capsule as claimed in claim 4, wherein the housing is cylindrical and further comprises a top, a bottom, and sides connecting the top and the bottom; the first acoustic opening is formed at the top; the second acoustic opening is formed at the sides; the third acoustic opening is formed at the bottom; and the fourth acoustic opening is formed at the sides.

6. A multi-microphone capsule, comprising:

a housing;

a first electret sensor disposed in the housing;

a second electret sensor disposed in the housing;

an integrated circuit disposed in the housing, receiving and amplifying electrical signal from the first and second electret sensors;

an acoustic seal disposed in the housing, wherein the first and second electret sensors are disposed on a side of the acoustic seal; and a third electret sensor disposed on the other side of the acoustic seal.

7. The multi-microphone capsule as claimed in claim 6, wherein the housing comprises a first acoustic opening receiving first sound waves on the first and second electret sensors; and a second acoustic opening receiving second sound waves on the third electret sensor.

8. The multi-microphone capsule as claimed in claim 7, wherein the housing is cylindrical and further comprises a top, a bottom, and sides connecting the top and the bottom; the first acoustic opening is formed at the top; and the second acoustic opening is formed at the bottom.

9. The multi-microphone capsule as claimed in claim 6, wherein the housing comprises an acoustic opening receiving sound waves on the first and second electret sensors.

10. The multi-microphone capsule as claimed in claim 9, wherein the housing is cylindrical and further comprises a top, a bottom, and sides connecting the top and the bottom; the acoustic opening is formed at the top.

* * * * *